US007927223B2

(12) United States Patent
Bussink

(10) Patent No.: US 7,927,223 B2
(45) Date of Patent: Apr. 19, 2011

(54) AMUSEMENT RIDE

(75) Inventor: Ronald Alexander Bussink, Appenzell (CH)

(73) Assignee: Ronald Bussink Amusement Design GmbH, Düsseldorf (DE)

( * ) Notice: Subject to any disclaimer, the term of this patent is extended or adjusted under 35 U.S.C. 154(b) by 18 days.

(21) Appl. No.: 11/613,546

(22) Filed: Dec. 20, 2006

(65) Prior Publication Data

US 2007/0261589 A1 Nov. 15, 2007

Related U.S. Application Data

(60) Provisional application No. 60/759,374, filed on Jan. 17, 2006.

(30) Foreign Application Priority Data

Dec. 21, 2005 (EP) ..... 05028076

(51) Int. Cl.
*A63G 31/00* (2006.01)

(52) U.S. Cl. ..... 472/131; 187/404; 187/406; 104/53

(58) Field of Classification Search ..... 104/53; 472/43; 187/245, 249, 404, 406
See application file for complete search history.

(56) References Cited

U.S. PATENT DOCUMENTS

| | | | | |
|---|---|---|---|---|
| 5,036,954 | A * | 8/1991 | Haahtikivi et al. | 187/406 |
| 5,566,785 | A * | 10/1996 | Hakala | 187/250 |
| 5,628,690 | A * | 5/1997 | Spieldiener et al. | 472/131 |
| 5,732,635 | A * | 3/1998 | McKoy | 104/73 |
| 5,893,802 | A * | 4/1999 | Bohme | 472/131 |
| 6,397,756 | B1 * | 6/2002 | Saiko et al. | 104/53 |
| 6,460,657 | B1 * | 10/2002 | Isenburg et al. | 187/245 |
| 2002/0103033 | A1 * | 8/2002 | Stengel | 472/131 |
| 2004/0077415 | A1 * | 4/2004 | Kleimeyer | 472/1 |
| 2007/0131489 | A1 * | 6/2007 | Stalder | 187/404 |
| 2007/0261589 | A1 * | 11/2007 | Bussink | 104/53 |
| 2007/0270231 | A1 * | 11/2007 | Bussink | 472/43 |
| 2008/0093177 | A1 * | 4/2008 | Fargo | 187/249 |

FOREIGN PATENT DOCUMENTS

| | | | |
|---|---|---|---|
| BE | 540 794 | A | 9/1955 |
| DE | 842 614 | C | 6/1952 |
| DE | 198 16 768 | A1 | 11/1999 |
| DE | 19816768 | A1 * | 11/1999 |
| WO | WO 2004/067126 | | 8/2004 |
| WO | WO 2004067126 | A1 * | 8/2004 |

OTHER PUBLICATIONS http://en.wikipedia.org/wiki/Top_Thrill_Dragster, 2003.*
http://www.rcdb.com/document89.htm, Feb. 26, 2003.*
http://www.cedarpoint.com/public/park/rides/coasters/top_thrill_dragster/index.cfm, 2003.*

* cited by examiner

*Primary Examiner* — S. Joseph Morano
*Assistant Examiner* — Jason C Smith
(74) *Attorney, Agent, or Firm* — Henry M. Feiereisen; Ursula B. Day

(57) ABSTRACT

An amusement ride includes a support structure generally having the shape of a vertical standing arch that spans from a first ground base to a second ground base. Movably supported on the support structure is at least one vehicle for carrying one or more passengers at least partially along a length of the support structure from an initial loading position at one of the first and second ground bases. The vehicle is hereby lifted by a lifting device from the initial loading position upwards along the support structure and slowed down by a braking mechanism when it travels from an elevated position in a downward direction along the support structure.

10 Claims, 7 Drawing Sheets

AMUSEMENT RIDE

CROSS-REFERENCES TO RELATED APPLICATIONS

This application claims the benefit of prior filed U.S. provisional Application No. 60/759,374, filed Jan. 17, 2006, pursuant to 35 U.S.C. 119(e), the content of which is incorporated herein by reference in its entirety as if fully set forth herein.

This application also claims the priority of European Patent Application, Serial No. 05 028 076.7, filed Dec. 21, 2005, pursuant to 35 U.S.C. 119(a)-(d), the content of which is incorporated herein by reference in its entirety as if fully set forth herein.

BACKGROUND OF THE INVENTION

The invention relates, in general, to an amusement ride.

Nothing in the following discussion of the state of the art is to be construed as an admission of prior art.

In the field of amusement rides, there are two different concepts for moving a vehicle that carries one or more passengers along a structure. On the one hand, roller coasters are known, which provide their entertainment to the passengers by extreme shapes of the track, for example loops or helices. Alternatively, vertical towers are known, which take their entertainment from lifting the vehicle vertically upwards to an elevated position and letting the vehicle drop vertically along a set length along the structure thereby simulating a "free fall". Such a tower is known, for example, from U.S. Pat. No. 5,628,690. A combination of a roller coaster course with a free fall tower is known from published U.S. Pat. Appl. No. 2002/0103033 A1. These concepts are disadvantageous with respect to the desire of certain customers to enjoy a ride to an elevated position without the stress situations that roller coasters or free-fall towers create. Furthermore, free-fall towers are known to be limited in their capacity of handling customers, as the tower-structure cannot be used while passengers embark and disembark the vehicle, leaving the large tower structure with prolonged downtimes.

Customers who are interested in slower rides to reach elevated positions, big wheels or Ferris Wheels are known. These structures are however very large and obstruct large areas of air space, giving them a prominent but sometimes unwanted dominance. Furthermore, the round trip along a big wheel has been considered as conventional by certain customers looking for different rides.

It would therefore be desirable and advantageous to provide an improved amusement ride to obviate prior art shortcomings.

SUMMARY OF THE INVENTION

According to one aspect of the present invention, an amusement ride includes a support structure generally having the shape of a vertical standing arch that spans from a first ground base to a second ground base, at least one vehicle movably supported on the support structure for carrying one or more passengers at least partially along a length of the support structure from an initial loading position at one of the first and second ground bases, a lifting device lifting the vehicle from the initial loading position upwards along the support structure, and a braking mechanism for braking the vehicle when it travels from an elevated position in a downward direction along the support structure.

The invention is based on the idea of using a vertical standing arch as a support structure on which at least one vehicle is movably supported. Using a standing arch as support structure eliminates the presence of a space-obstructing structure in the form of a big wheel, but at the same time allows passengers to be transported to a highly elevated position. The invention further does away with the known simple tower-structures, allowing a different type of ride to these tower structures, namely one where the orientation of the vehicle can change during the ride from a position at a substantially vertical structure, namely close of one of the ground bases, to a position at a substantially horizontal structure at the top of the arch.

The support structure according to the invention has the geometric shape of a vertical standing arch. Such an arch is oriented essentially vertical in the area of the first ground base and the second ground base, and is orientated essentially horizontal at the top of the arch. Depending on the ground orientation at the site, where the amusement ride is to be assembled, at least one of the two ground bases could conceivably be arranged in an area, where the ground has a slope. The arch-shaped geometry of the support structure according to the invention thus is also to be understood to encompass arches, where the section of the support structure close to a ground base that stands on a sloping ground is orientated at an angle to the vertical, for example is orientated perpendicular to the sloping ground. Currently preferred however is a support structure which is substantially symmetrical. Suitably, the arch is also designed to lie in one vertical plane.

The amusement ride comprises at least one vehicle which is movably supported on the support structure for carrying one or more passengers at least partially along the length of the support structure starting from an initial loading position at one of the first and second ground bases. The amusement ride according to the invention can be used to primarily shuttle the passengers from the one ground base to the other ground base while giving the passengers the enjoyment of an elevated view during shuttle operation. In such embodiment of the invention, the amusement ride has one vehicle movably supported on the support structure for carrying one or more passengers along the length of the support structure from an initial loading position at one of the first and second ground bases to an unloading position at the other ground base. The vehicle will thus shuttle from the one ground base to the other ground base.

According to another embodiment of the invention, the amusement ride may put emphasis on a high throughput of passengers who can be provided with an elevated view. In such an embodiment, the amusement ride can have two vehicles, wherein a first vehicle is provided to travel from the first ground base along a first leg of the arch-shaped support structure to an elevated position, and a second vehicle is provided to travel from the second ground base along the second leg of the arch-shaped support structure to the elevated position. Ideally, each vehicle returns to its starting position from the elevated position. Preferably, both vehicles are operated to travel in opposite directions. For example, the one vehicle can be held in the elevated position, giving the passengers a prolonged elevated view, while at the same time passengers of the second vehicle embark and disembark at the respective ground base. Afterwards, the first vehicle is caused to travel downwards to its ground base, while the second vehicle is lifted, leading to the situation where the second vehicle is then held at the elevated position for an extended time, while passengers of the first vehicle disembark and embark at the respective ground base. Such an arrangement makes efficient use of the support structure, as the capacity to handle customers can be raised compared to previously known vertical rides According to another feature of the present invention, the first vehicle and the second vehicle may be interconnected in such a manner that a downward movement of the one vehicle leads to an upward movement of the other vehicle. Such an arrangement results in an energy-efficient operation of the amusement ride, because the downward movement of the one vehicle can be used at least in part for lifting the other vehicle. Currently preferred is an interconnection of both vehicles by means of a cable. This can be a singular cable, with the respective vehicles being connected to the respective ends of the cable. Suitably, the cable is arranged as a cable-loop that runs along the length of the support structure and returns via a link from the first ground base to the second ground base.

Depending on the chosen way of operating the amusement ride, the support of the vehicle(s) can be arranged in such a way as to allow the vehicle to run along the length of the support structure from the first ground base to the second ground base. For specific reasons, for example cost reasons or structural reasons, in embodiments where two vehicles are arranged to run along their respective legs of the arch, the support of the vehicles can be designed in such a way as to hinder one vehicle from completely running along the length of the support structure, but holds the vehicle always on one side of the arch.

The amusement ride according to the invention has a lifting device for lifting the vehicle from the loading position upwards along the support structure, and a braking mechanism for decelerating the vehicle when it travels from the elevated position in a downward direction along the support structure. Configurations of such lifting devices and braking mechanisms are basically known from free-fall tower designs, for example from U.S. Pat. No. 5,628,690, or from known elevator constructions in buildings. For example, designs having a counterweight that is connected to the vehicle via a cable can be used. Also, known braking mechanisms, especially conventional emergency braking mechanisms for catching a free-running cable in an emergency that are especially used in building-elevator structures can also be used to provide safety to the amusement ride according to the invention.

According to another feature of the present invention, a cable may be affixed to the vehicle for lifting the vehicle. Using a cable to move the vehicle provides an efficient way for controlling the travel of the vehicle, given the technological advance that such cable-driven-systems have reached in the business of amusement rides and elevators in buildings. However, as an alternative, the vehicle may, of course, be lifted by other systems as well, for example by hydraulic cylinders.

According to another embodiment of the present invention, involving at least one vehicle connected to a cable that allows for lifting of the vehicle, the cable may be arranged as a cable-loop. This loop preferably, although not necessarily, runs along the length of the support structure and returns via a link from the first ground base to the second ground base. Preferably a driving mechanism and/or the braking mechanism are arranged to act upon the cable as it runs along the link from the first ground base to the second ground base. This allows for an easy construction, where the at times somewhat large driving and/or braking mechanisms can be arranged on the ground, for example in between the two ground bases, but still can act effectively on the cable as it runs along the link from the first ground base to the second ground base. Such an arrangement allows for the support structure to be designed without having to account for large driving and/or braking mechanisms and thus allows for the support structure to be designed as a slim arc, which is aesthetically pleasing.

According to another feature of the present invention, the link between the first base and the second base and the driving and/or braking mechanism acting on the cable as it runs along the link can be hidden in tunnels in the ground, thus further enhancing the appearance of the amusement ride.

According to another feature of the present invention, the vehicle may be moveably supported along at least one rail provided on the support structure. There are numerous ways of moveably supporting the vehicle on the support structure. For example, the vehicle can have wheels that roll along the outer surface of a support structure, with the support structure preferably being arranged in such a way that the wheels are prevented from running off the support structure. Such an arrangement of wheels is for example shown in International Publ. No. WO 2004/067126 A1. As an alternative, the support structure may have at least a singular rail, on which the vehicle is set.

According to another feature of the present invention, the support structure may be permanently secured to the ground. Suitably, the support structure is secured to the ground by means of affixing the first ground base and the second ground base permanently to the ground, for example, by providing the ground bases with a foundation. Of course, the present invention covers also designs that allow easy transport of the amusement ride.

Though the amusement ride can obviously be used as part of a fair, especially in a transportable version, the amusement ride, especially in its permanently installed embodiment can be designed as large structure, for example having a height of between 50 and 150 meters. Such constructions can for example be used as land-marks in cities, for example as creative bridges over obstructions, like rail roads or rivers. The amusement ride can for example be also used as "Entrance gate" to theme parks, allowing passengers to have an overview over the theme park.

According to another feature of the present invention, the support structure may have a hollow core. This allows elements necessary for moving the vehicles, like for example cables and counterweights, to be hidden inside the support structure, providing the support structure with a smooth look.

According to another feature of the present invention, the vehicle may have a mounting that is moveably supported on the support structure, whereby at least one passenger compartment, like a cabin for example, is attached to the mounting in a pivotable manner. Such an embodiment allows for the passenger compartment to maintain a given orientation, for example an orientation whereby the passengers are held looking horizontally. As the mounting for the passenger compartment travels along the support structure, the pivotable holding of the passenger compartment allows for the passenger compartment to adopt to the change of orientation of the mounting, that is dependent on the changing orientation of the support structure along its length, i. e. from a vertical orientation in the area of the ground bases to a horizontal orientation on the top of the arch.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
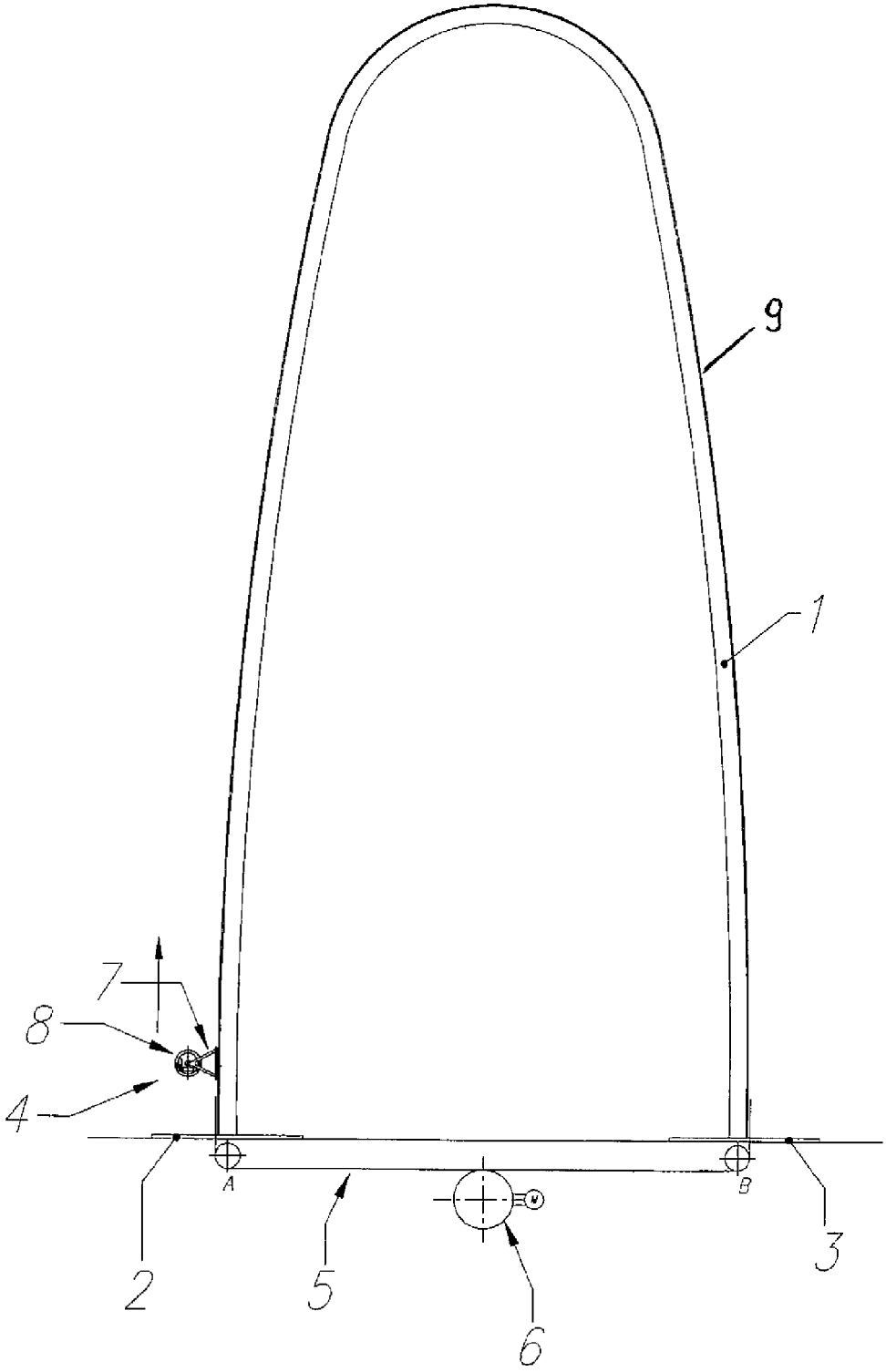
FIG. 1 is a schematic side view of a first embodiment of an amusement ride according to the present invention, depicting a vehicle in a first position.

Throughout all the Figures, same or corresponding elements are generally indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic side view of a first embodiment of an amusement ride according to the present invention, including a support structure 1 having the shape of a vertical standing arch that spans from a first ground base 2 to a second ground base 3. A vehicle 4 is movably supported on the structure 1 for carrying one or more passengers at least partially along the length of the support structure 1 from an initial loading position at the first ground base 2.

A cable 9 is affixed to the vehicle 4 and runs along the length of the structure 1 and returns via a link 5 from the first ground base 2 to the second ground base 3. In the embodiments shown here, the link 5 is designed as an underground tunnel.

A motor 6 is provided to act upon the cable 9 as it runs along the link 5 from the first ground base 2 to the second ground base 3. Together with the motor 6, the cable 9 acts as a lifting mechanism for lifting the vehicle 4 from the loading position upwards along the support structure 1 and—with the motor 6 being used as a generator—acts as braking mechanism for decelerating the vehicle 4 when it travels from an elevated position in a downward direction along the support structure 1.

The vehicle 4 is movably supported on the support structure 1 by a mounting 7 and has at least one passenger compartment in the form of a capsule 8, which is attached to the mounting 7 in a pivotable manner.

Figure 2:
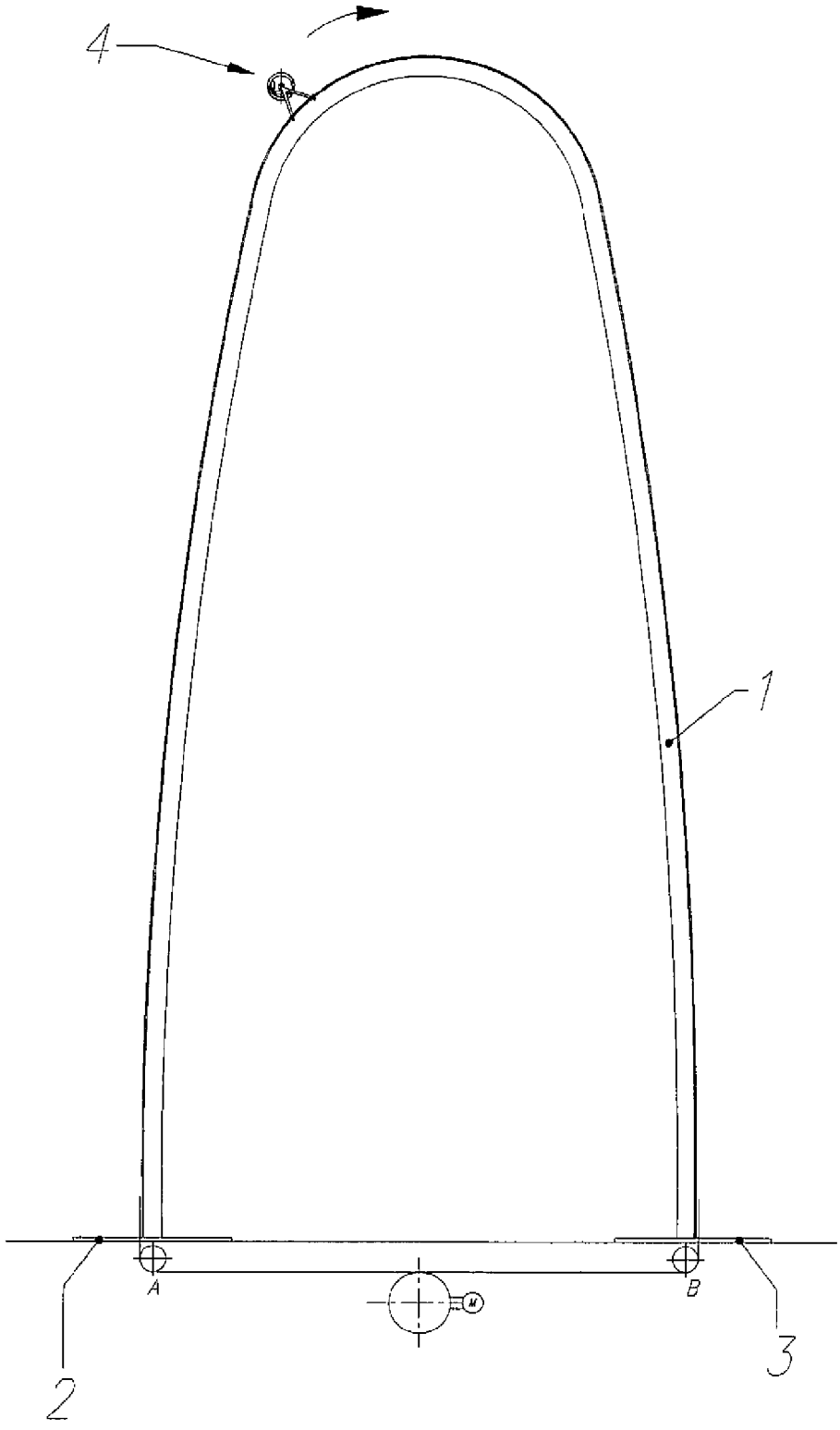
FIG. 2 is a schematic side view of the amusement ride of FIG. 1, depicting the vehicle in a second position.
Figure 3:
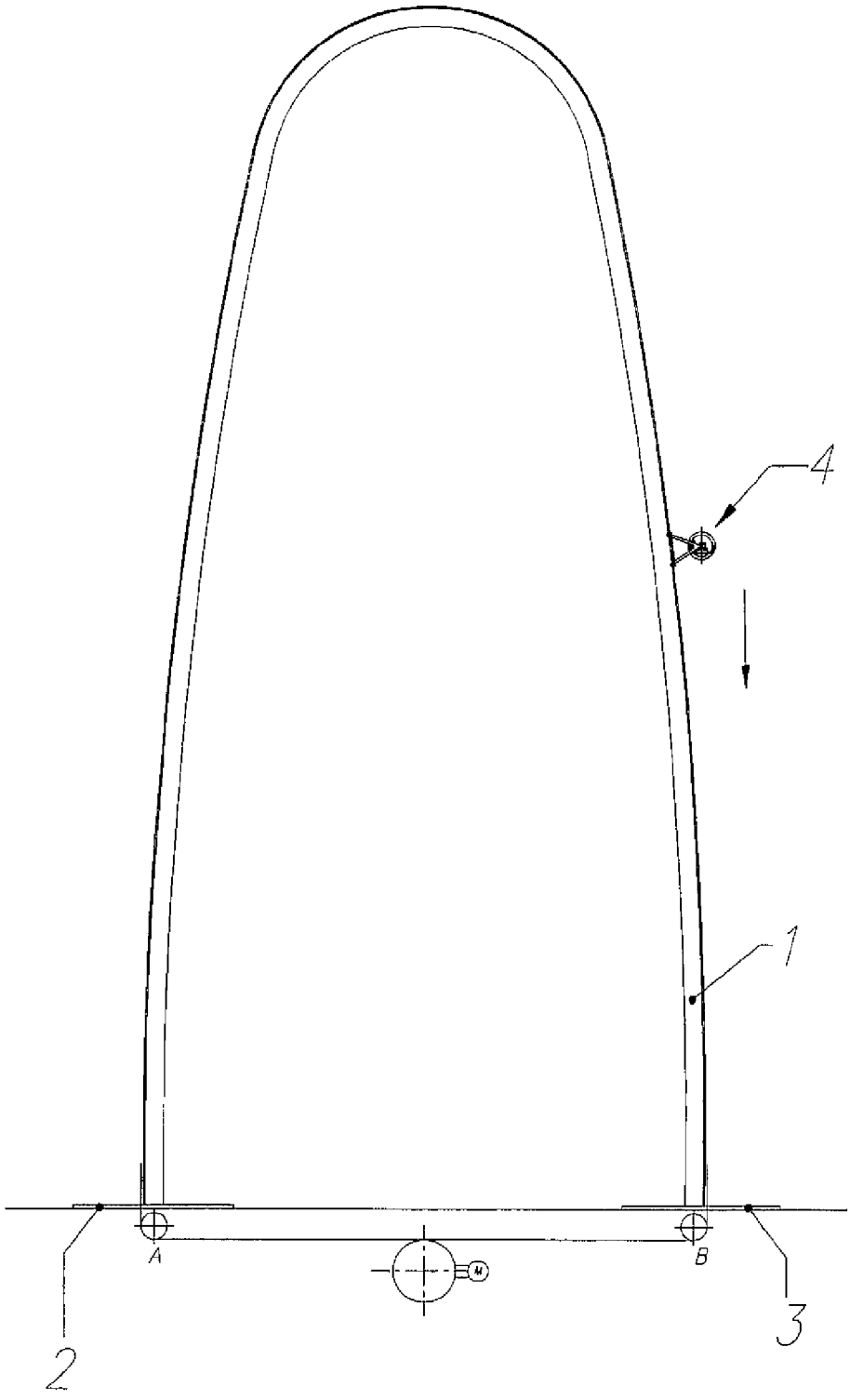
FIG. 3 is a schematic side view of the amusement ride of FIG. 1, depicting the vehicle in a third position.

As can be seen from FIGS. 1, 2 and 3, when viewed in sequence, the vehicle 4 of the amusement ride is moved along the support structure 1 from the first ground base 2 to the second ground base 3, operating as a shuttle from the one ground base to the other ground base. Having reached the second ground base 3, passengers can disembark and new passengers can embark, making the second ground base 3 the new initial loading position. The vehicle 4 then returns to the first ground base 2 by traveling back along the support structure 1.

As can be seen when looking at the capsule 8 and a standing passenger depicted therein, arranging the capsule 8 in a pivotable manner on the mounting 7 allows the capsule 8 to maintain its overall orientation, thereby allowing the passenger to remain in a standing position, as shown in the Figures.

Figure 4:
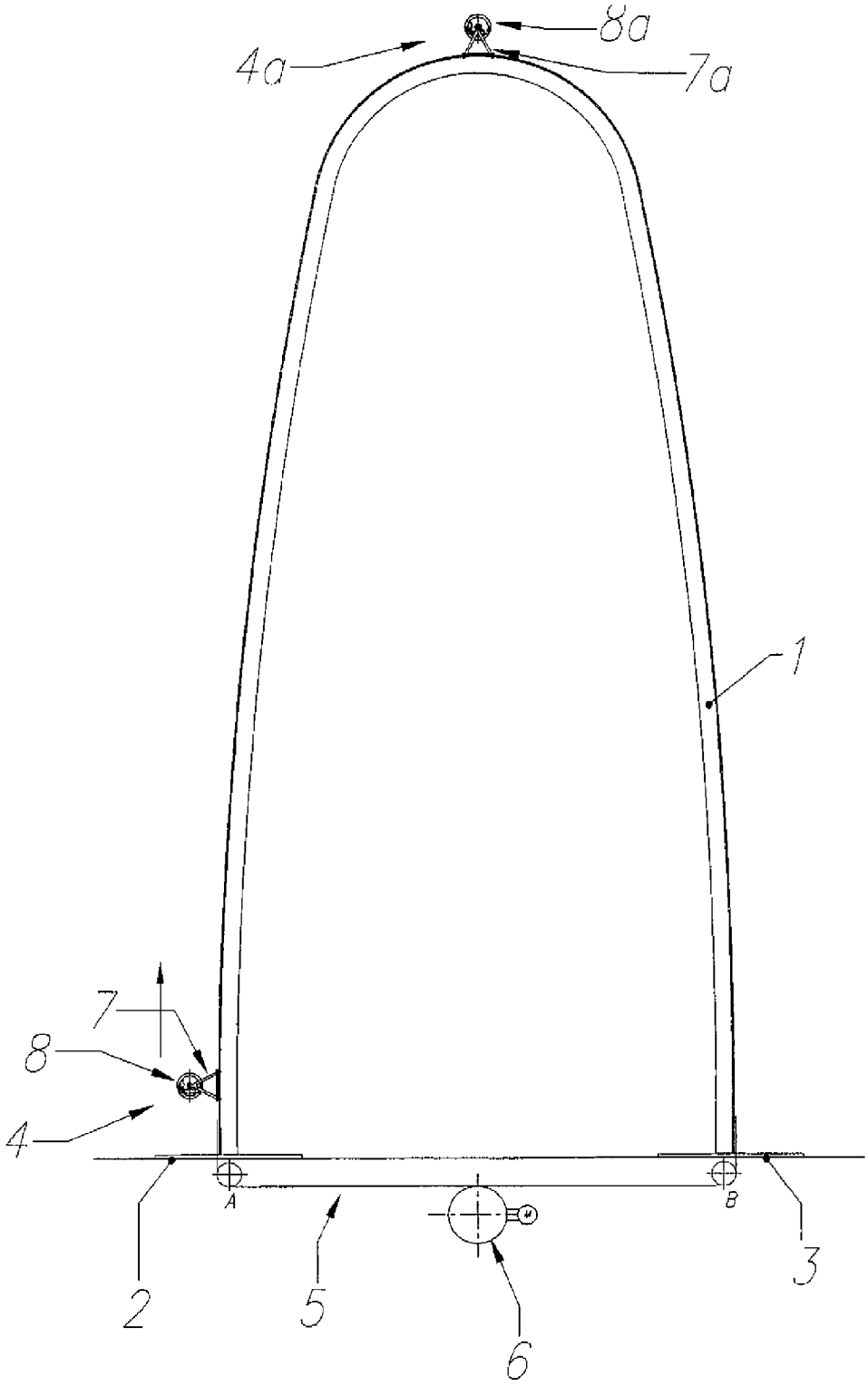
FIG. 4 is a schematic side view of a second embodiment of an amusement ride according to the present invention, depicting two vehicles in first relative positions.
Figure 5:
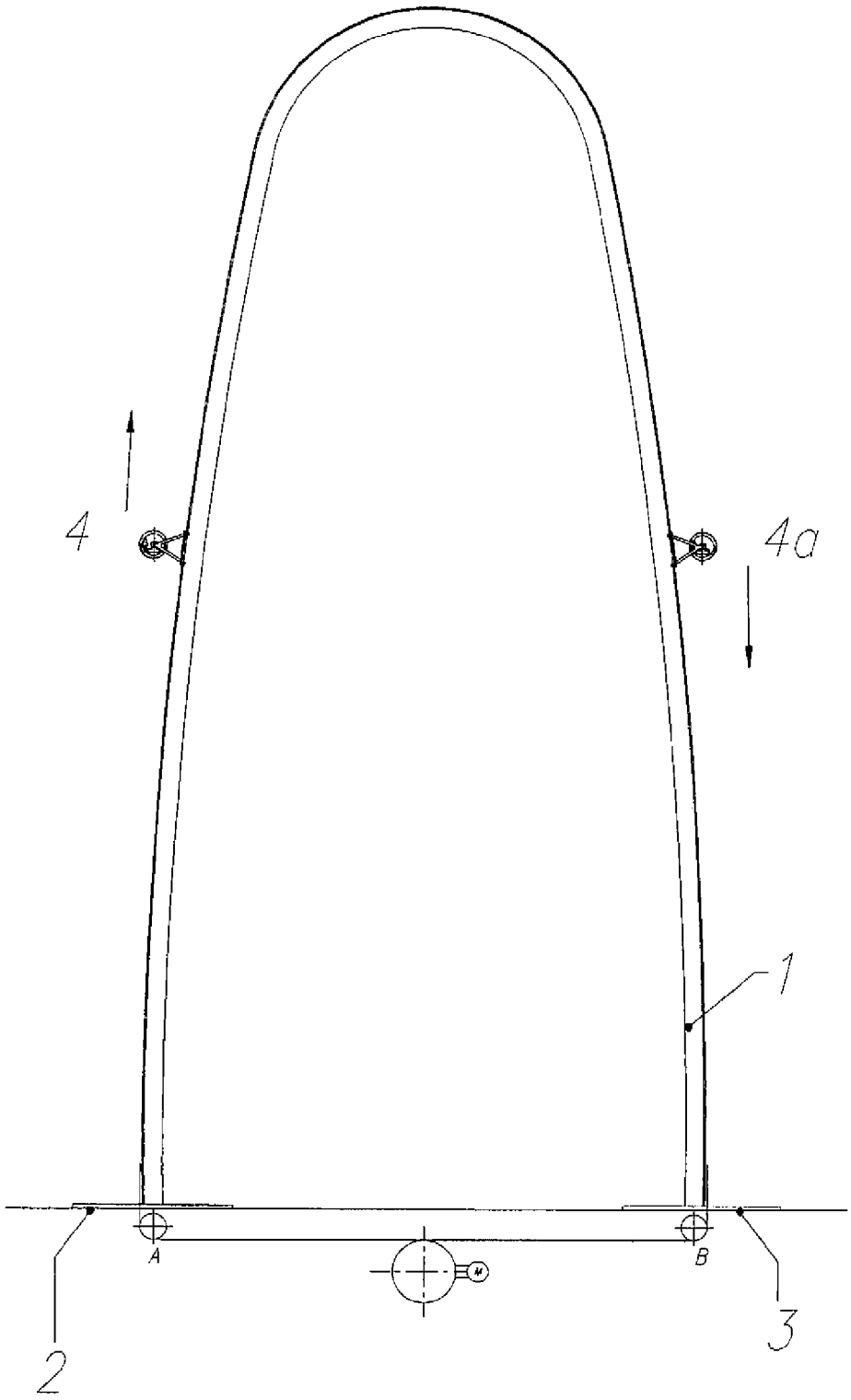
FIG. 5 is a schematic side view of the amusement ride of FIG. 4, depicting the vehicles in second relative positions.
Figure 6:
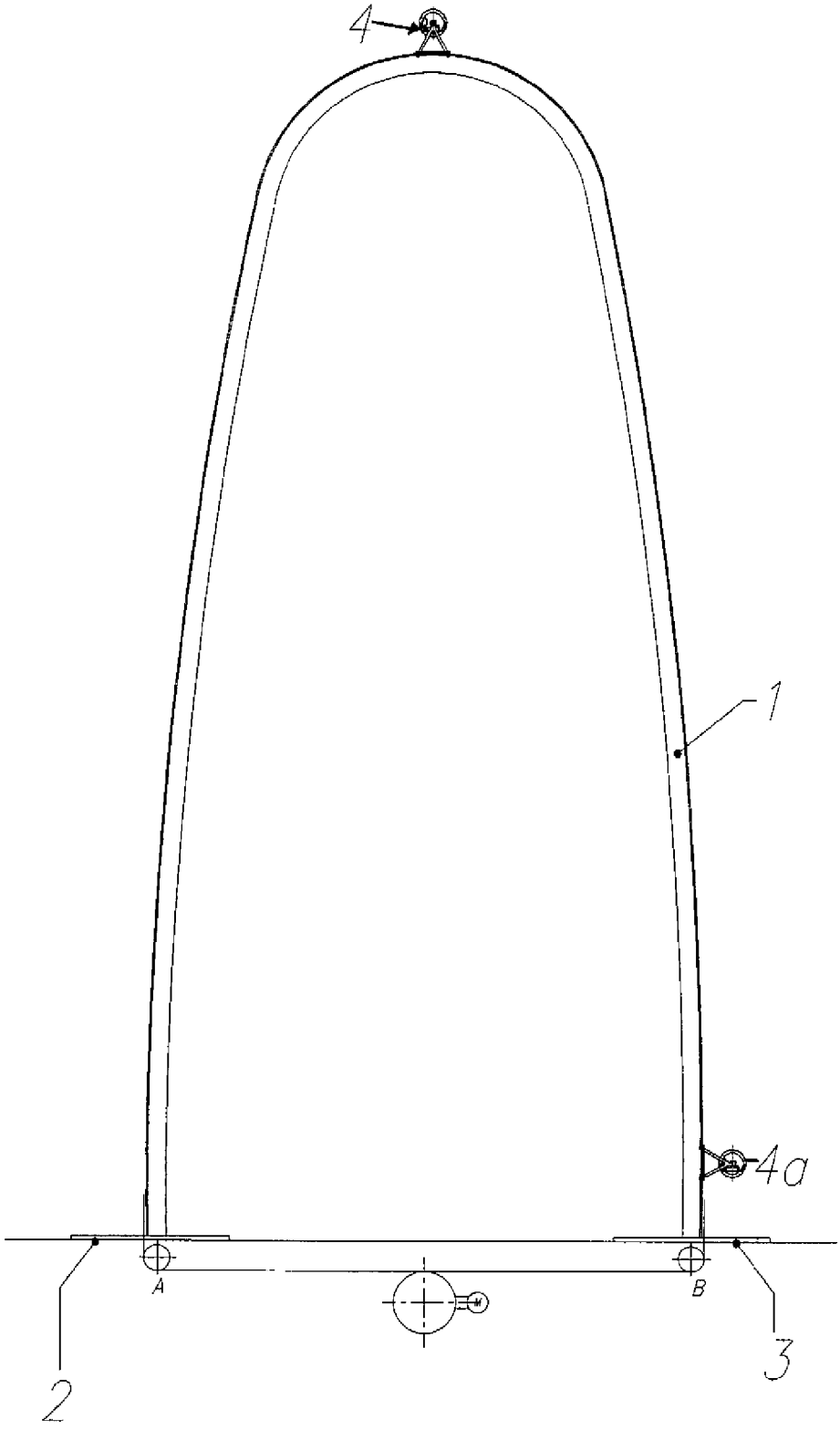
FIG. 6 is a schematic side view of the amusement ride of FIG. 4, depicting the vehicles in third relative positions.

FIGS. 4 to 6 show a second embodiment of an amusement ride according to the present invention. Parts corresponding with those in FIG. 1 are denoted by identical reference numerals and not explained again. The description below will center on the differences between the embodiments. In this embodiment, provision is made for two vehicles 4, 4*a* that travel in opposite directions. As shown in FIG. 4 the vehicle 4 is in a loading position, while the second vehicle 4*a* is held at an elevated position, giving the passengers a prolonged bird's-eye view. After loading new passengers, vehicle 4 travels upwards along the first leg of the arch-shaped support structure 1, while the second vehicle 4*a* travels downwards on the second leg of the arch-shaped structure towards the second ground base 3. Reaching the second ground base 3, passengers can disembark from the second vehicle 4*a* and new passengers can embark this vehicle 4*a*, while the passengers in the first vehicle 4 can enjoy a prolonged view from the bird's-eye position. After loading of the new passengers is completed at the second ground base 3, the first vehicle 4 travels back to the first ground base 2, while the second vehicle 4*a* travels upwards along the second leg of the arch-shaped structure 1 towards the uppermost elevated position.

Figure 7:
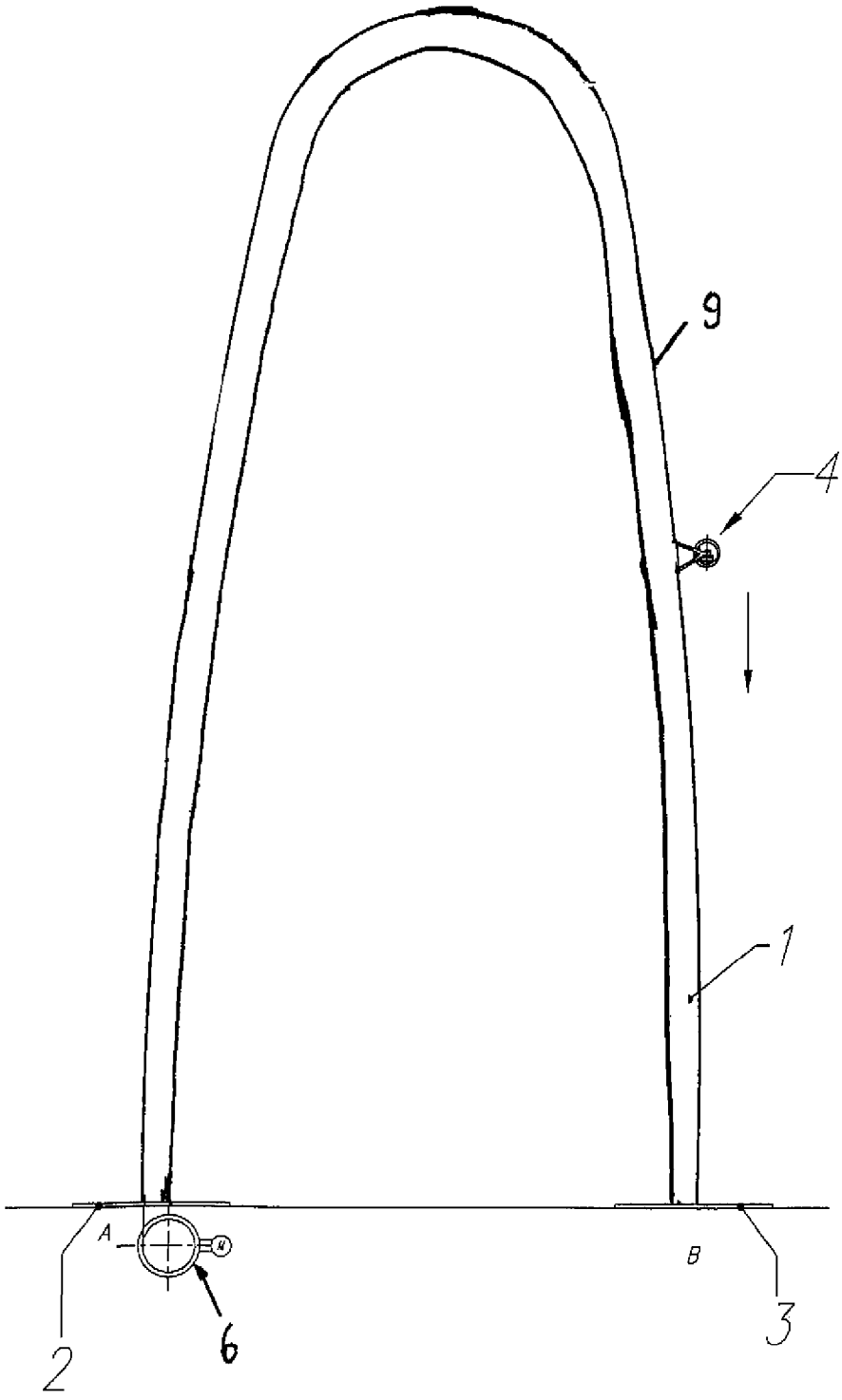
FIG. 7 is a schematic side view of a third embodiment of an amusement ride according to the present invention.

FIG. 7 shows a third embodiment of an amusement ride according to the present invention. Parts corresponding with those in FIG. 1 are denoted by identical reference numerals and not explained again. The description below will center on the differences between the embodiments. In this embodiment, the lifting device for operating the vehicle 4 is arranged at the first ground base 2. A motor 6 can wind or unwind the cable 9 which is fixed to the vehicle 4 and can thereby lift and—if the motor 6 is used as a generator—slow down the vehicle 4.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An amusement ride, comprising:

a support structure generally having the shape of a vertical standing arch that spans from a first ground base on one side of the support structure to a second ground base on another side of the support structure;

at least one vehicle movably supported on the support structure for carrying one or more passengers at least partially along a length of the support structure from an initial loading position at one of the first and second ground bases;

a cable affixed to the vehicle and arranged as a closed cable-loop that runs along the length of the support structure and returns via a link between the first ground base and the second ground base; and a motor acting upon the cable as it runs along the link to operate as a lifting device for lifting the vehicle from the initial loading position upwards along the support structure, and to operate as a braking mechanism for braking the vehicle when it travels from an elevated position in a downward direction along the support structure.

2. The amusement ride of claim 1, wherein the vehicle on the support structure, the lifting device and the braking mechanism are constructed to allow the vehicle to be moved from the initial loading position at one of the first and second ground bases to an unloading position at the other one of the first and second ground bases.

3. The amusement ride of claim 1, further comprising at least one rail mounted to the support structure, wherein the vehicle is movably supported along the at least one rail.

4. The amusement ride of claim 1, wherein the support structure is fixedly secured to the ground by affixing the first ground base and the second ground base permanently to the ground.

5. The amusement ride of claim 1, wherein the support structure has a hollow core.

6. The amusement ride of claim 1, wherein the vehicle has a mounting which is movably supported on the support structure and has at least one passenger compartment attached to the mounting in a pivotable manner.

7. The amusement ride of claim 1, further comprising a further said vehicle, wherein the at least one vehicle is caused to travel from the first ground base along a first leg of the support structure to an elevated position and the further vehicle is caused to travel from the second ground base along the second leg of the support structure to the elevated position.

8. The amusement ride of claim 7, wherein the at least one vehicle and the further vehicle are interconnected in such a manner that a downward movement of the one of the vehicles leads to an upward movement of the other one of the vehicles.

9. The amusement ride of claim 1, wherein the support structure has a symmetric configuration.

10. The amusement ride of claim 1, wherein the link and the motor are positioned in an underground tunnel.

* * * * *